United States Patent [19]

Hansson

[11] 4,278,136

[45] Jul. 14, 1981

[54] SINKERDRILL

[76] Inventor: Göte I. Hansson, Strandvägen 31, S-453 00 Lysekil, Sweden

[21] Appl. No.: 134,062

[22] Filed: Mar. 26, 1980

[30] Foreign Application Priority Data

Mar. 20, 1979 [SE] Sweden ..... 7902850

[51] Int. Cl.[3] ..... E21B 4/16

[52] U.S. Cl. ..... 175/93; 173/78; 173/80; 175/99; 175/103; 175/106; 299/62

[58] Field of Search ..... 175/92–101, 175/103, 106, 107, 170, 173, 189, 217, 230; 173/78, 80, 105; 299/62

[56] References Cited

U.S. PATENT DOCUMENTS

| | | | |
|---|---|---|---|
| 1,287,477 | 12/1918 | Simpson | 175/96 X |
| 2,643,860 | 6/1953 | Koch | 175/99 |
| 3,194,329 | 7/1965 | Wallers | 175/101 X |
| 3,225,843 | 12/1965 | Ortloff et al. | 175/93 |
| 3,596,722 | 8/1971 | Allard | 175/93 |

FOREIGN PATENT DOCUMENTS

| | | | |
|---|---|---|---|
| 735818 | 4/1943 | Fed. Rep. of Germany | 175/93 |

*Primary Examiner*—James A. Leppink
*Assistant Examiner*—Richard E. Favreau
*Attorney, Agent, or Firm*—Robert E. Burns; Emmanuel J. Lobato; Bruce L. Adams

[57] ABSTRACT

A down-the-hole rock drill including a drill bit provided at the lower end of a drill rod, which is rotatably driven by an above-the-ground motor. To increase the drilling efficiency and facilitate drilling of large-diameter holes a machine casing is positioned between the drill rod and the drill bit, said casing enclosing a hydraulic pump which is rotatably driven by the drill rod. The hydraulic pump delivers pressurized liquid to and drives the percussion unit including a hammer, the latter delivering blows against the drill bit at regular intervals. The machine casing also encloses at least one hydraulic motor driven by the pressurized liquid and arranged to rotate the drill bit. Hydraulically controllable blocking means prevent the machine casing from rotating relative to the drill hole wall while the drill bit is in operation.

4 Claims, 3 Drawing Figures

SINKERDRILL

BACKGROUND OF THE INVENTION

The subject invention relates to a sinker drill or down-the hole rock drill using a percussion drill bit provided at the lower end of the drill rod, the latter being rotatably driven from an above-the-ground driving motor.

Several kinds of drilling machines of this kind are already known. In accordance with one type of such drills, an hydraulically or pneumatically operated percussion machine is used at the upper end of the drill rod. The hammer blows must propagate over the full length of the entire drill rod which consists of a number of sections that must be joined together, and consequently the impact on the drill bit is considerably reduced. To remedy this drawback, a drilling machine has been designed, wherein the percussion machine is positioned at the lower end of the drill rod, whereby the hammer blows will hit the drill bit directly. Hitherto, the only possibility to drive percussion machines of this kind has been with the aid of compressed air or hydro-electrically from units positioned above the ground. However, when the drill holes are large, in the order of between 0.5 to 1 meter in diameter or more, percussion machines driven pneumatically or hydro-electrically via a turbine give an effect (power) that is too small to make their operation economical.

SUMMARY OF THE INVENTION

The subject invention provides an excellent and simple solution to the problem of obtaining high-efficiency sinker drilling to drill large holes.

It is characteristic of the invention that between the drill rod and the drill bit is positioned a machine casing enclosing a hydraulic pump which is rotatably driven by the drill rod and which delivers pressurized liquid to a percussion tool which is driven by the pump and includes a hammer, said hammer arranged to deliver blows against the drill bit at regular intervals, at least one hydraulic motor, driven by the pressure liquid, positioned in said machine casing and arranged to rotate the drill bit, said machine casing additionally comprising hydraulically controllable blocking means to prevent said casing from rotating but allow it to sink relative to the wall of the drill hole while said drill bit is in operation, said blocking means controlled with the aid of pressurized liquid from the hydraulic pump.

BRIEF DESCRIPTION OF THE DRAWINGS

Further characteristics of the invention will appear from the following detailed description with reference to the accompanying, partly diagrammatical drawings, wherein.

DETAILED DESCRIPTION OF A PREFERRED EMBODIMENT

Figure 1:
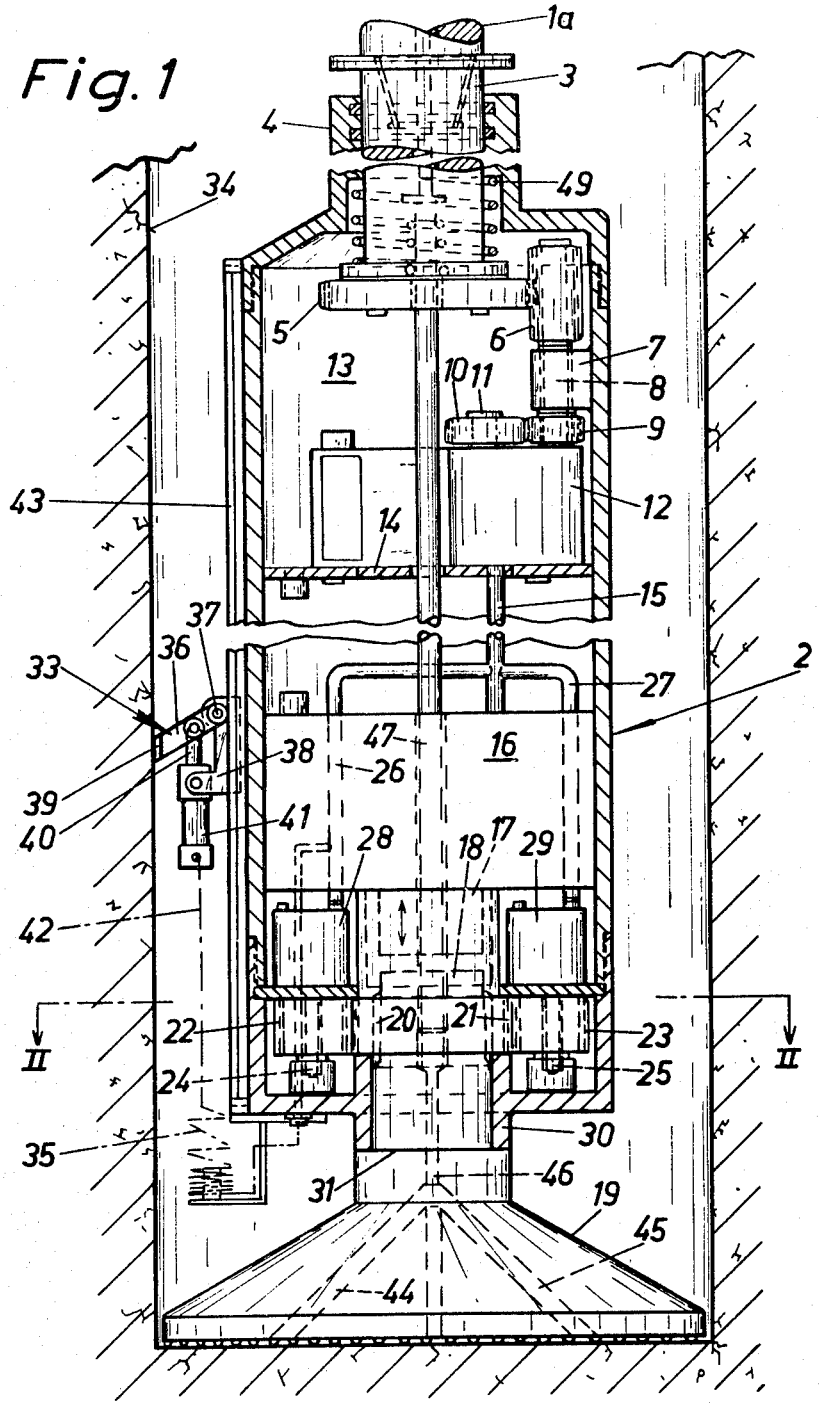
FIG. 1 is a vertical longitudinal section through a drilling machine positioned at the bottom of a drill hole.

At the lower end of the drill rod 1, which consists of a number of joined-together drill rod sections 1*a*, 1*b*, is provided a cylindrical machine casing 2. The lower end of the drill rod section 1*a* is secured to a pipe stub 3 by means of screws, said pipe stub being rotatably mounted in a bearing 4 at the upper end of the machine casing 2. The lower end of the pipe stub 3 is in the shape of a cog wheel 5, alternatively, this end is provided with such a wheel, said wheel cooperating with a smaller cog wheel 6 provided at the upper end of a vertical shaft 8 which is rotatably mounted in a bearing 7 in the interior of the machine casing 2. At the lower end of the shaft 8 is mounted a cog wheel 9 which cooperates with a cog wheel 10 provided at the upper end of the input shaft 11 of a hydraulic pump 12. Together with the above-mentioned gearing unit, comprising cog wheels 5, 6, 9, and 10, the hydraulic pump is enclosed in a liquid container 13 which is separated from the rest of the machine casing 2 by a bottom wall 14. An output line 15 carrying pressure liquid, preferably oil, from the hydraulic pump 12 is connected to a hydraulically driven percussion machine 16, the vertically driven hammer 17 of which delivers its blows against the upper end 18 of a drill bit 19. The end 18 of said drill bit is provided with lengthwise positioned splines 20 engaging in matching grooves formed on the inner face of a cog wheel 21, thus allowing the drill bit to be displaced axially relative to the cog wheel. The latter cooperates with two diametrically opposed cog wheels 22, 23, each one of which is mounted on its respective one of drive shafts 24 and 25. Each drive shaft 24, 25 is connected to its associated hydraulic motor 28, 29 by means of conduits 26 and 27, respectively. The return conduits from the percussion machine 16 and the hydraulic motors 28, 29 are not shown in the drawings in order not to unnecessarily clutter the latter.

With the aid of a mounting collar 30 at the lower end of the machine casing 2 the entire load of the latter is supported on an annular collar 31 on the drill bit 19 which bit is slowly rotated via the cog wheels 22, 23 and 21 by the motors 28, 29, for instance at a speed of between 7 and 30 r/min, in one direction, preferably in the same direction as the rotational direction of the drill rod 1, the rotational direction of whichis determined by the rotational direction of a drive motor 32 connected to the upper end of the drill rod section 1*b*.

In order to prevent the machine casing from turning about its lengthwise axis upon rotational movements of the drill rod 1 and the drill bit 19, the machine casing is provided with blocking elements 33 which in their operative position are pressed against the wall 34 of the hole 35 made by the drill bit 19. In accordance with the embodiment illustrated in the drawings each blocking element 33 consists of an arm 36 the inner end of which by means of a bolt 37 is secured to a slide 38. The blocking elements are each formed with a gripping end 39 which is swung into engagement with the wall 34 of the drill hole by the piston rod 40 of a hydraulic cylinder unit 41, the latter being supplied with pressurized liquid via a hose 42 from the hydraulic pump 12 when the latter is operative. The slide 38 is arranged for displacement along a longitudinally extending guide 43 provided on the outer face of the machine casing 2.

The drill bit 19 is provided with channels 44, 45 and 46, the latter of which is connected by means of a tube 47 which extends through the machine casing 2 to the axial channel 48 formed in the drill rod 1, said channel serving to supply flushing liquid.

For the purpose of eliminating the need of loading the drill bit 19 with the weight of the entire drill rod 1 a spring means 49 is inserted between the rod 1 and the machine casing 2, in addition to which the drill rod 1 is maintained in a suspended position by a traction rope 50 which is slackened as the drilling work proceeds.

The drilling machine operates in the following manner. When the motor 32 is started and the drill rod 1 begins to rotate, the pressure rises in the hydraulic pump and consequently also in the cylinder 41, resulting in the piston rod 40 swinging the blocking arm 36 to the operative position of the latter in abutment against the hole wall 34. In the initial position, the slide 38 and the entire blocking element 33 are at the lower end of the guide 43. When the hydraulic pressure in the percussion machine 16 has risen to a sufficiently high level, the machine starts to operate and the hammer 17 delivers heavy blows at regular intervals against the upper end of the drill bit 19 which, while rotated by the motors 28, 29, works itself through the rock. The machine casing 2 as well as the drill rod 1 follow the down-ward movement of the drill bit whereas the blocking elements 33 remain in engagement with the hole wall 34. When the drilling has continued over a distance which corresponds to the length of one drill rod section 1*a* and another drill rod section 1*b* is to be joined thereto at the upper end of the drill rod section 1*a*, the drive motor 32 is stopped, and consequently the rotation of the drill rod 1, the gearing unit 5, 6, 9 and 10 and the hydraulic pump 19 ceases accordingly. The hydraulic pressure is reduced, also in the cylinder 41, and the blocking element 33 loosens its grip against the hole wall 34. The slide 38 and the blocking elements 33 sink by gravity down to the lower end of the guide 43. When the drive motor 32 is re-started, the course of events just described is repeated and the drilling operation is continued over the length of another drill rod section.

Figure 2:
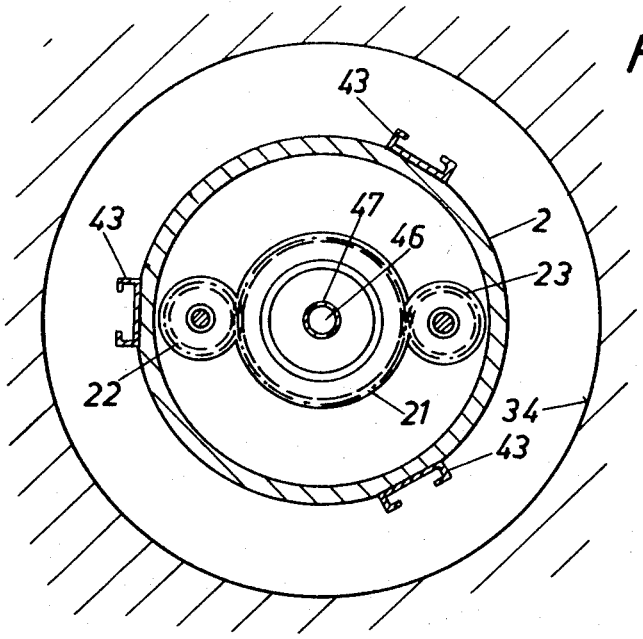
FIG. 2 is a cross section through the machine along line II—II of FIG. 1.
Figure 3:
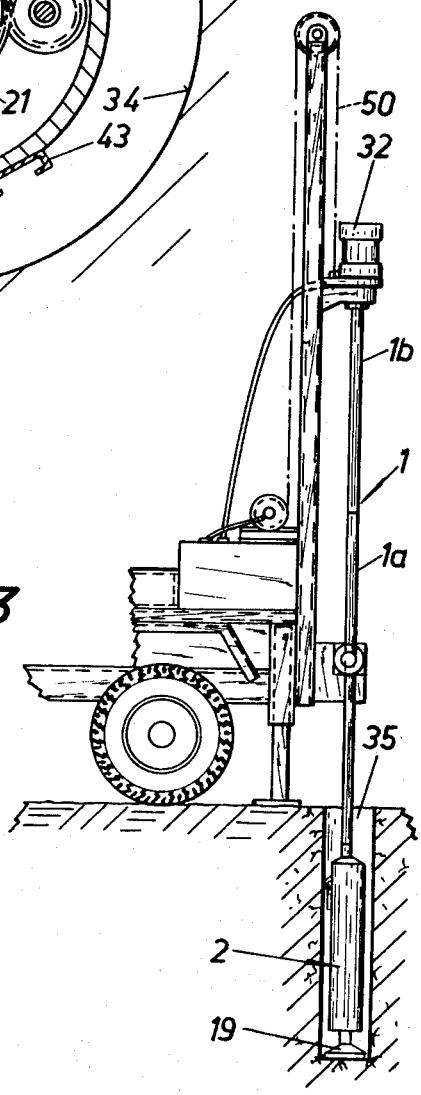
FIG. 3 illustrates on a reduced scale the rear end of a machinery associated with the drilling machine.

As appears from FIG. 2, it might be convenient to use three blocking elements 33, each formed with its associated lengthwise guide 43. These guides are preferably spaced equal distances apart along the outer face of the machine casing 2. The blocking elements can also be constructively altered in several other ways within the scope of the invention.

The same is true of the hydraulic pump 12, the percussion machine 16 and the means pertaining to the rotatably driven drill bit 19.

What I claim is:

1. An improved rock drill including a percussion drill bit provided at the lower end of a drill rod, and a drive motor positioned above ground and arranged to rotate said drill rod, the improvement comprising a machine casing positioned between said drill rod and said drill bit and enclosing a hydraulic pump rotatably driven by said drill rod, and a percussion element including a hammer, said hammer arranged to deliver blows at regular intervals against said drill bit, said hydraulic pump driving said percussion element and supplying pressurized liquid thereto, and at least one hydraulic motor housed inside said machine casing and driven by the hydraulic liquid, said hydraulic motor arranged to rotatably drive said drill bit, and hydraulically controllable blocking means provided on said machine casing to prevent said casing from rotating but allow it to sink relative to the wall of the drill hole while said drill bit is in operation, said blocking means controlled by pressurized liquid from said hydraulic pump.

2. An improved rock drill as claimed in claim 1, a liquid collection container in said machine casing, said container enclosing said hydraulic pump.

3. An improved rock drill as claimed in claim 1, comprising a liquid collection container in said machine casing, said container enclosing said hydraulic pump as well as a gear unit positioned between the drill rod and the output shaft of said hydraulic pump.

4. An improved rock drill as claimed in claim 1, comprising an annular shoulder on said drill bit, the lower end of said machine casing resting on said shoulder.

* * * * *